United States Patent [19]

McDonald

[11] 4,045,984

[45] Sept. 6, 1977

[54] KEY HOLDER

[76] Inventor: Wallace McDonald, Apt. E2, 1701 W. Larpenteur, St. Paul, Minn. 55113

[21] Appl. No.: 665,781

[22] Filed: Mar. 10, 1976

[51] Int. Cl.[2] ..... A47G 29/10

[52] U.S. Cl. ..... 70/456 R; 70/461

[58] Field of Search ..... 70/456 R, 456 B, 457, 70/458, 459, 461; 24/3 K; 150/40

[56] References Cited

U.S. PATENT DOCUMENTS

| | | | |
|---|---|---|---|
| 1,944,470 | 1/1934 | Schlage | 70/461 X |
| 1,965,472 | 7/1934 | Shook | 70/456 R |
| 2,402,347 | 6/1946 | Rotheraine | 70/456 R |
| 2,472,337 | 6/1949 | Olson | 70/456 R |
| 3,119,249 | 1/1964 | Goldstein | 70/456 R |

*Primary Examiner*—Robert L. Wolfe

*Attorney, Agent, or Firm*—Allen D. Brufsky

[57] ABSTRACT

A key holder including at least a pair of spaced rigid plates having a stud extending therebetween pivotally mounting a key for movement between a stored position wholly between the plates and a use position extending beyond the perimeter of said plates. A pivotal L-shaped lever is positioned between the plates for contacting the key upon movement being imparted thereto to rotate the key from its stored to its use position.

4 Claims, 3 Drawing Figures

KEY HOLDER

BACKGROUND OF THE INVENTION

This invention relates to a key holder, and more particularly, a key holder having means for manually moving a key from a stored to a use position.

One conventional key holder is a plastic enclosure for keys which employs threadedly engageable studs to retain the keys in the holder. The keys are retained on the threaded shank of the stud between a pair of plates which threadedly receive the stud. A significant problem associated with this type of key holder is the difficulty in removing a key from a stored position in the holder to a use position, because once stored, the frictional contact between the key and the sides of the plates preclude pivotal movement of the key about its mounting stud.

SUMMARY OF THE INVENTION

The present invention solves this problem by providing a key holder of the type described including means for manually moving a key from a stored to a use position. The means include a pivotal lever mounted between the plates of the key holder having a portion extending from the holder for contact with a finger and a lever arm for contact with the key to rotate the key about its mounting stud.

BRIEF DESCRIPTION OF THE DRAWINGS

Further objects and advantages of the invention will become apparent from the following description and claims, and from the accompanying drawing, wherein:

DETAILED DESCRIPTION OF THE PREFERRED EMBODIMENT

Figure 1:
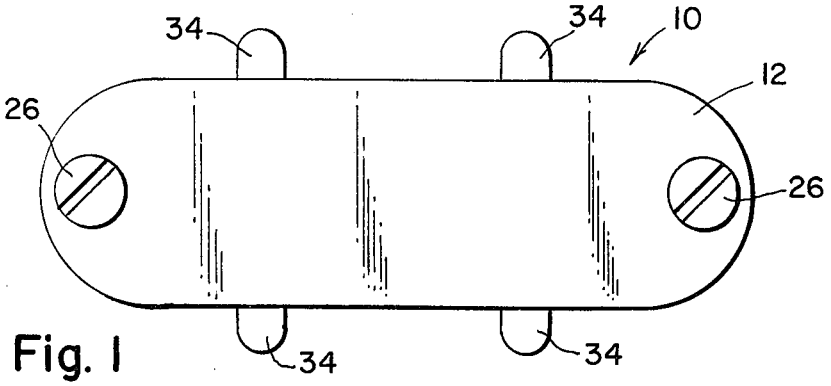
FIG. 1 is a front view in elevation of the key holder of the present invention.
Figure 2:
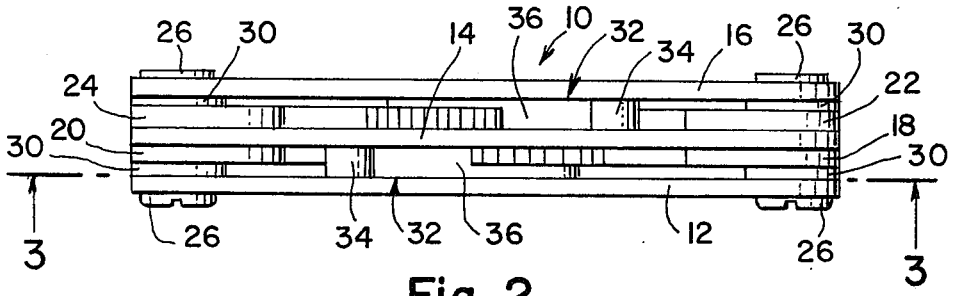
FIG. 2 is a top view in elevation of the key holder of FIG. 1.

Referring now to the drawing in detail, wherein like numerals indicate like elements throughout the several views, the key holder 10 of the present invention includes a rigid, ovoid plastic front plate 12, an identical center plate 14, and an identical back plate 16 for mounting and enclosing four keys 18, 20, 22 and 24. A pair of the keys is mounted between two of the plates, and it should be understood that additional plates may be added to the construction if more than four keys are to be mounted in key holder 10.

The means for mounting each key in key holder 10 includes a stud 26 having a threaded shank 28 threadedly engaged in the front plate 12 or back plate 16 and the center plate 14. Shank 28 of stud 26 is inserted through the keyhole of one of the keys 18–24 before being threaded into center plate 18. A washer 30 on shank 28 of stud 26 normally frictionally clamps the key against center plate 14, although the key is pivotal about shank 28 because shank 28 is smaller in diameter than the keyhole in the key.

An L-shaped lever 32 having a finger contacting portion 34 and key contacting portion 36 is associated with each key 18–24. Each lever 32 is pivotally mounted on a pin 38 integral with the back plate 16 or front plate 12 extending through one of a series of holes 40 in the longer, key contacting portion of lever 32. Pin 38 is received within a hole (not shown) in the center plate 14.

In order to move one of the keys, for example key 18, from its stored position within holder 10 to a use position exterior of holder 10, its associated lever 32, for key 18 the top left lever, has its finger contacting portion 34 extending above the outer perimeter of the plates 12, 14, 16 rotated about its mounting pin 38. This will cause portion 36 of L-shaped lever 32 to contact and rotate key 18 about shank 28 of its mounting stud 26, until key 18 is in a use position exterior of key holder 10.

Figure 3:
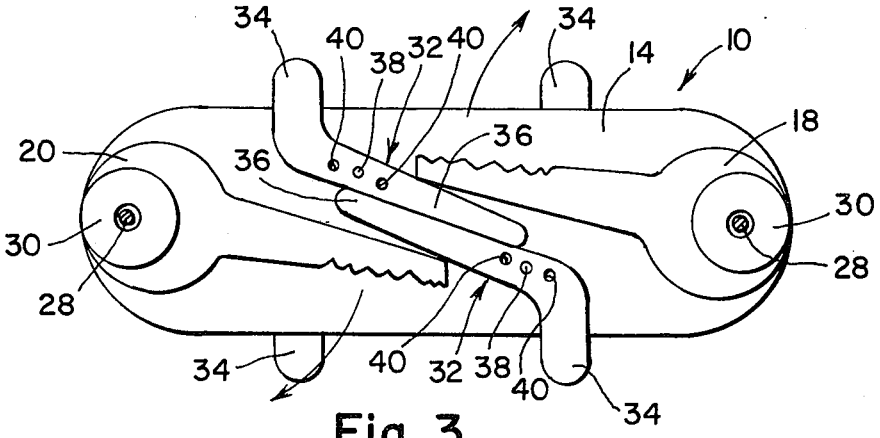
FIG. 3 is a cross-sectional view of the key holder taken substantially along the plane indicated by line 3—3 of FIG. 2.

18 can be returned to the interior of the holder 10 by rotating key 18 unitl it is within holder 10 between plates 12 and 14. Key 18 will automatically return lever 32 to the position shown in FIGS. 1 and 3 wherein portion 34 is accessible from the exterior of the holder 10.

Holes 40 in each lever 32 permit the lever to be remounted so that portion 36 will contact shorter or longer keys, as required. If desired, finger contacting portions 34 of each lever 32 can be color or indicia coded to correspond with a particular key mounted in key holder 10.

I claim:

1. A key holder comprising a first rigid plate, a second rigid plate, key retaining means extending between said first and second plates for pivotally mounting a key for movement from a stored position wholly between said plates to a use position wherein a portion of said key extends outwardly beyond the perimeter of said plates, and an L-shaped lever pivotally mounted between said plates whose longer leg is a portion contacting and rotating a key mounted on said key retaining means from it stored to its use position, said longer leg including a series of holes for selectively receiving a pivot pin mounting said lever between said plates, and whose shorter leg normally extends beyond the perimeter of said plates for finger contact to pivot said lever.

2. A key holder in accordance with claim 1 including more than one key retaining means and a lever means associated with each of said key retaining means for contacting and rotating a key mounted on each of said key retaining means.

3. A key holder in accordance with claim 1 wherein said key retaining means includes a stud threadedly connected between said plates.

4. A key holder in accordance with claim 3 including a washer mounted on the shank of said stud.

* * * * *